US011382427B2

(12) United States Patent
Yang

(10) Patent No.: US 11,382,427 B2
(45) Date of Patent: Jul. 12, 2022

(54) FOLDING CHAIR

(71) Applicant: WESTFIELD OUTDOORS GMBH, Krefeld (DE)

(72) Inventor: Baoqing Yang, Hangzhou (CN)

(73) Assignee: WESTFIELD OUTDOORS GMBH, Krefeld (DE)

( * ) Notice: Subject to any disclaimer, the term of this patent is extended or adjusted under 35 U.S.C. 154(b) by 0 days.

(21) Appl. No.: 17/290,508

(22) PCT Filed: Dec. 11, 2019

(86) PCT No.: PCT/EP2019/084616
§ 371 (c)(1),
(2) Date: Apr. 30, 2021

(87) PCT Pub. No.: WO2020/120560
PCT Pub. Date: Jun. 18, 2020

(65) Prior Publication Data

US 2021/0368987 A1 Dec. 2, 2021

(30) Foreign Application Priority Data

Dec. 11, 2018 (CN) ..... 201822077295.9

(51) Int. Cl.
*A47C 4/28* (2006.01)

(52) U.S. Cl.
CPC ..... *A47C 4/286* (2013.01)

(58) Field of Classification Search
CPC ..... A47C 4/286
(Continued)

(56) References Cited

U.S. PATENT DOCUMENTS 4,072,341 A 2/1978 Kurz
5,570,926 A 11/1996 Papiemik et al.
(Continued)

FOREIGN PATENT DOCUMENTS

CN 2897032 Y * 5/2007
CN 2897032 Y 5/2007
(Continued)

*Primary Examiner* — Anthony D Barfield
(74) *Attorney, Agent, or Firm* — Thompson Coburn LLP

(57) ABSTRACT

A folding chair, comprising two sets of link assemblies that are connected to each other and are respectively located at two sides of the folding chair, wherein the link assembly comprises a least a backrest tube (2), an armrest (4), a seat tube (7), a front foot tube (8), a rear foot tube (9), a connecting tube (10) and a connecting portion, wherein the armrest (4) is rotatably connected with the backrest tube (2), wherein the connecting tube (10) is connected with the backrest tube (2), wherein the connecting tube (10) is rotatably connected with the backrest tube (2), wherein the connecting tube (10) is rotatably connected with the front foot tube (8), wherein a top end of the front foot tube (8) is rotatably connected with a top end of the rear foot tube (9), wherein the top end of the front foot tube (8) and/or the top end of the rear foot tube (9) is connected with the armrest (4), wherein the seat tube (7) is rotatably connected with the backrest tube (2) and the front foot tube (8), wherein the seat tube (7) and/or the backrest tube (2) is slidably connected with the rear foot tube (9) or the connecting tube (10), wherein the connecting portion is rotatably connected with the connecting tube (10), and wherein the connecting portion is connected with the rear foot tube (9).

19 Claims, 9 Drawing Sheets

(58) Field of Classification Search
USPC ..... 297/16.2
See application file for complete search history.

(56) References Cited

U.S. PATENT DOCUMENTS

| | | | |
|---|---|---|---|
| 6,692,068 | B1 | 2/2004 | Tang |
| 2003/0006632 | A1 | 1/2003 | Ku |
| 2009/0072592 | A1 | 3/2009 | Zheng |
| 2010/0237665 | A1 | 9/2010 | Grace |

FOREIGN PATENT DOCUMENTS

| | | | |
|---|---|---|---|
| CN | 201533682 | U | 7/2010 |
| CN | 202035773 | U | 11/2011 |
| CN | 202820372 | U | 3/2013 |
| CN | 208318773 | U | 1/2019 |
| WO | 9009749 | A1 | 9/1990 |

* cited by examiner

FOLDING CHAIR

CROSS-REFERENCE TO RELATED APPLICATIONS

This application is a U.S. National Phase application of PCT/EP2019/084616, filed on Dec. 11, 2019, claiming the benefit of Chinese Patent Application No. 201822077295.9, filed on Dec. 11, 2018, both of which are incorporated herein by reference in their entireties.

The present application relates to the technical field of chairs, and more particularly to a folding chair.

A folding chair is a chair that is portable and can be folded together. The folding chair is easily carried and is space-saving.

There are various kinds of folding chairs in the market. Generally, one end of a rear cross tube of the folding chair is connected to a rear foot tube of the folding chair, and another end of the rear cross tube is connected to a backrest of the folding chair. In this case, the size of the folding chair after being folded is large. In addition, for a folding chair in a small packaging size, when the folding chair is folded, one end of the rear cross tube slides on the backrest tube, and one end of the backrest tube slides on the rear foot tube. The size of this kind of folding chair is only reduced to a certain degree.

In summary, how to further reduce the size of the folding chair after being folded is an urgent technical problem to be solved by those skilled in the art.

An object of the present disclosure is to provide a folding chair, which has a small size after being folded and is easily carried and stored.

In order to achieve the above object, a folding chair is provided according to the present disclosure. The folding chair includes two sets of link assemblies that are connected to each other and are respectively located at two sides of the folding chair. The link assembly includes a backrest tube, an armrest, a seat tube, a front foot tube, a rear foot tube, a connecting tube and a connecting portion, where the armrest is rotatably connected with the backrest tube; the connecting tube is arranged at the bottom of the backrest tube, the connecting tube and the backrest tube are rotatable, the connecting tube is rotatably connected with the front foot tube, and the connecting tube is located at an inner side of the rear foot tube; a top end of the front foot tube is rotatably connected with a top end of the rear foot tube, the top end of the front foot tube or the top end of the rear foot tube is connected with the armrest; the seat tube is rotatably connected with both the backrest tube and the front foot tube, and one of the seat tube and the backrest tube is slidably connected with the rear foot tube or the connecting tube; and the connecting portion is rotatably connected with the connecting tube, and the connecting portion is connected with the rear foot tube.

Preferably, the connecting portion is a flip tube. One end of the flip tube is rotatably connected with the rear foot tube, and anther end of the flip tube is rotatably connected with the connecting tube. The flip tube is located at an outer side of the rear foot tube. One of the seat tube and the backrest tube is slidably connected with the connecting tube.

Preferably, the folding chair further includes two rear cross tubes that are crosswise to each other; and two supporting tubes that are crosswise to each other, where the two rear cross tubes and the two supporting tubes are arranged to connect the two sets of link assemblies; a top end of the rear cross tube is rotatably connected with the backrest tube, and a bottom end of the rear cross tube is rotatably connected with the connecting tube; a top end of the supporting tube is rotatably connected with the seat tube, and a bottom end of the supporting tube is rotatably connected with the front foot tube; and when the folding chair is folded, the two rear cross tubes and the two supporting tubes rotate relatively, and the two sets of link assemblies move towards each other.

Preferably, the front foot tube is provided with a connector hinged to the bottom of the supporting tube, the front foot tube is sleeved with a front foot slider located above the connector and slidable relative to the front foot tube, and a bottom end of the supporting rod is hinged to the front foot slider.

Preferably, the seat tube is provided with a front cross tab. The front cross tab includes a fixing plate and a hinge plate that are integrally formed with each other. The hinge plate extends towards a direction of the supporting tube. The fixing plate is fixedly connected with the seat tube, and the hinge plate is hinged to the supporting tube.

Preferably, the seat tube is rotatably connected with the backrest tube via a U-shaped piece. The U-shaped piece includes a fixing ring sleeved on the backrest tube and two connecting walls connected to the fixing ring. The two connecting walls extend towards a direction away from the backrest tube. One end of the seat tube is rotatably connected between the two connecting walls. A slider can be fixed to the bottom of the backrest tube, and the slider can be sleeved on the connecting tube to cause the connecting tube to slide relatively to the slider.

Preferably, an armrest supporting member is arranged on a lower surface of the armrest. The armrest supporting member is connected with the top end of the rear foot tube via a shaft that is rotatably connected with a U-shaped weld piece. Two wings of the U-shaped weld piece are respectively welded to two opposite sides of the top end of the front foot tube.

Compared with the conventional technology, in the folding chair provided in the present disclosure, the seat tube and the backrest tube are rotatably connected with each other, and the armrest is rotatable relative to the backrest tube. The top end of the front foot tube and the top end of the rear foot tube are connected to the armrest, and the top end of the front foot tube and the top end of the rear foot tube are rotatable. The seat tube and the backrest tube as a whole are slidably connected with the rear foot tube or the connecting tube. The connecting portion is rotatably connected with the connecting tube, and the connecting portion is connected with the rear foot tube. When the folding chair is folded, the bottom end of the front foot tube and the bottom end of the rear foot tube move towards each other, and the top end of the seat tube and the top end of the backrest tube move towards each other. No matter whether the connecting portion rotates or slides relative to the rear foot tube, the connecting portion drives the connecting tube to rotate towards a direction close to the rear foot tube, and the seat tube and the backrest tube move towards a direction close to the rear foot tube relative to the connecting tube. When the folding chair is unfolded, the bottom end of the front foot tube and the bottom end of the rear foot tube move away from each other, the top end of the seat tube and the top end of the backrest tube move away from each other, and the connecting portion and the connecting tube move towards a direction away from the ground relative to the rear foot tube. That is, the backrest tube is closer to the rear foot tube due to the movement of the connecting portion relative to the rear foot tube, and the seat tube is closer to the backrest tube. In other words, the seat tube, the backrest tube and the rear foot tube are closer to each other compared with the conventional technology, thereby reducing the size of the folding chair after being folded, and causing the folding chair to be easily carried and used.

BRIEF DESCRIPTION OF THE DRAWINGS

For more clearly illustrating technical solutions in embodiments of the present disclosure or in the conventional technology, drawings used to describe the embodiments or the conventional technology are briefly described hereinafter. Apparently, the drawings in the following description show only some embodiments of the present disclosure, and other drawings may be obtained by those skilled in the art based on the provided drawings without any creative work.

The figures each show in form of a schematic drawing.

List of reference signs:

| | |
|---|---|
| 1 backrest connector, | 2 backrest tube, |
| 3 rear cross tube, | 4 armrest, |
| 5 armrest connector, | 6 armrest supporting member, |
| 7 seat tube, | 8 front foot tube, |
| 9 rear foot tube, | 10 connecting tube, |
| 11 flip tube, | 12 flip connector, |
| 13 supporting rod, | 14 U-shaped piece, |
| 15 slider, | 16 front cross tab, |
| 17 supporting rod cover, | 18 front foot slider, |
| 19 foot cover, | 20 supporting tube, |
| 21 U-shaped weld piece, | 22 rear cross tab, |
| 23 rear tube folding arrangement, | 24 middle tube, |
| 25 folding tube. | |

DETAILED DESCRIPTION OF EMBODIMENTS

The technical solutions according to the embodiments of the present disclosure are described clearly and completely hereinafter in conjunction with the drawings in the embodiments of the present disclosure. Apparently, the described embodiments are only a part of the embodiments according to the present disclosure, rather than all of the embodiments. All other embodiments obtained by those skilled in the art based on the embodiments in the present disclosure without any creative work fall into the protection scope of the present disclosure.

In order to make those skilled in the art understand the technical solutions of the present disclosure better, the present disclosure is described in detail below in conjunction with the drawings and the embodiments of the present disclosure.

Figure 1:
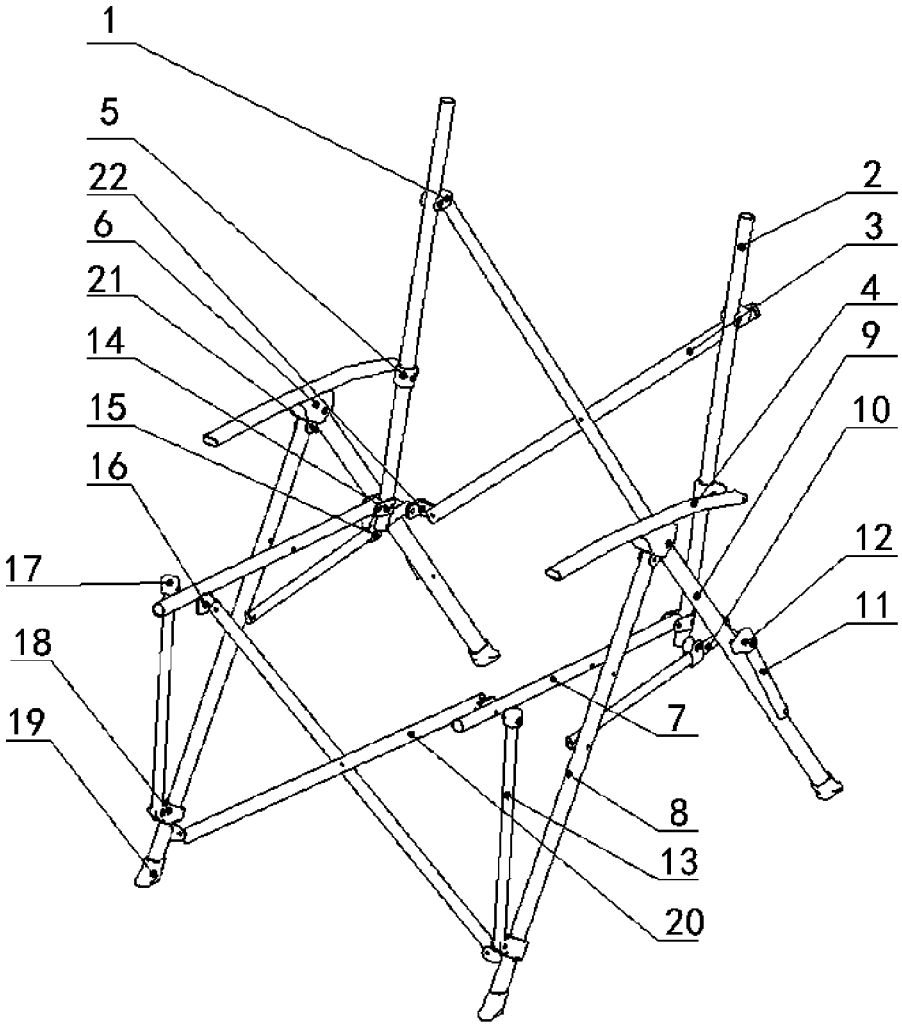
FIG. 1 a folding chair according to a first embodiment.
Figure 2:
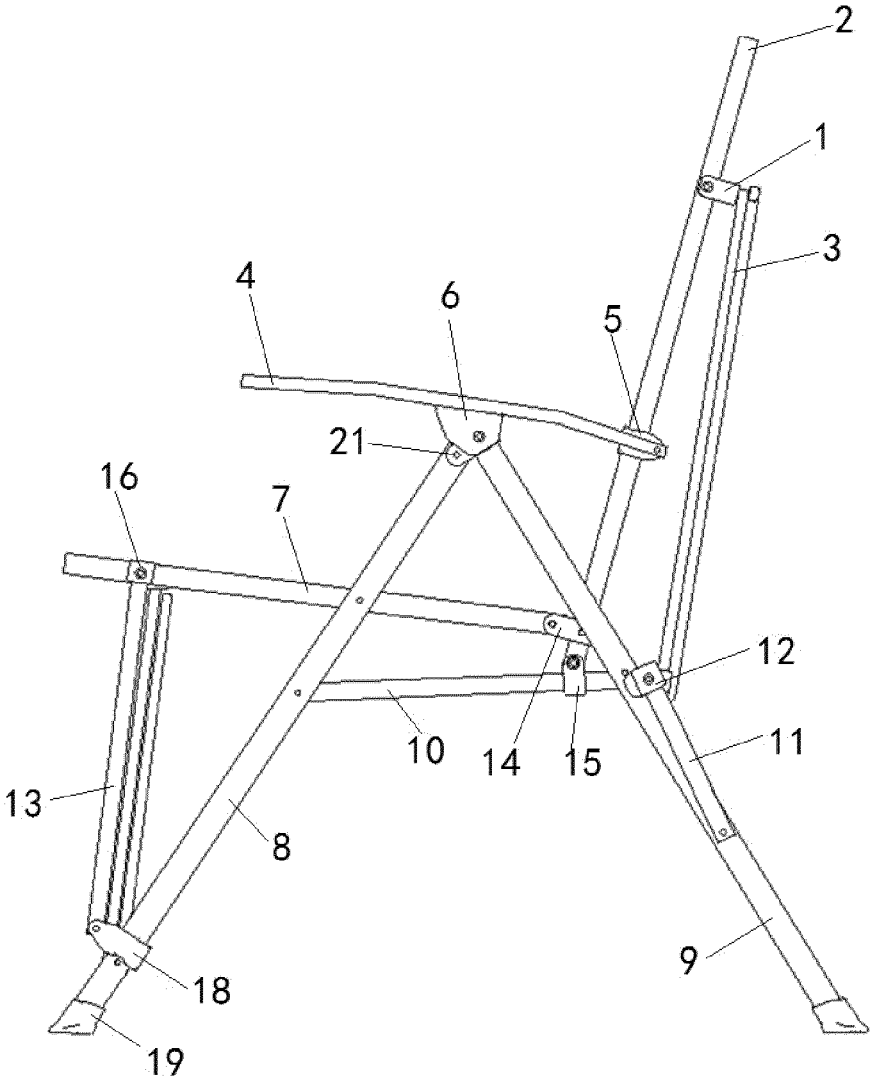
FIG. 2 a side view of the folding chair according to FIG. 1.
Figure 3:
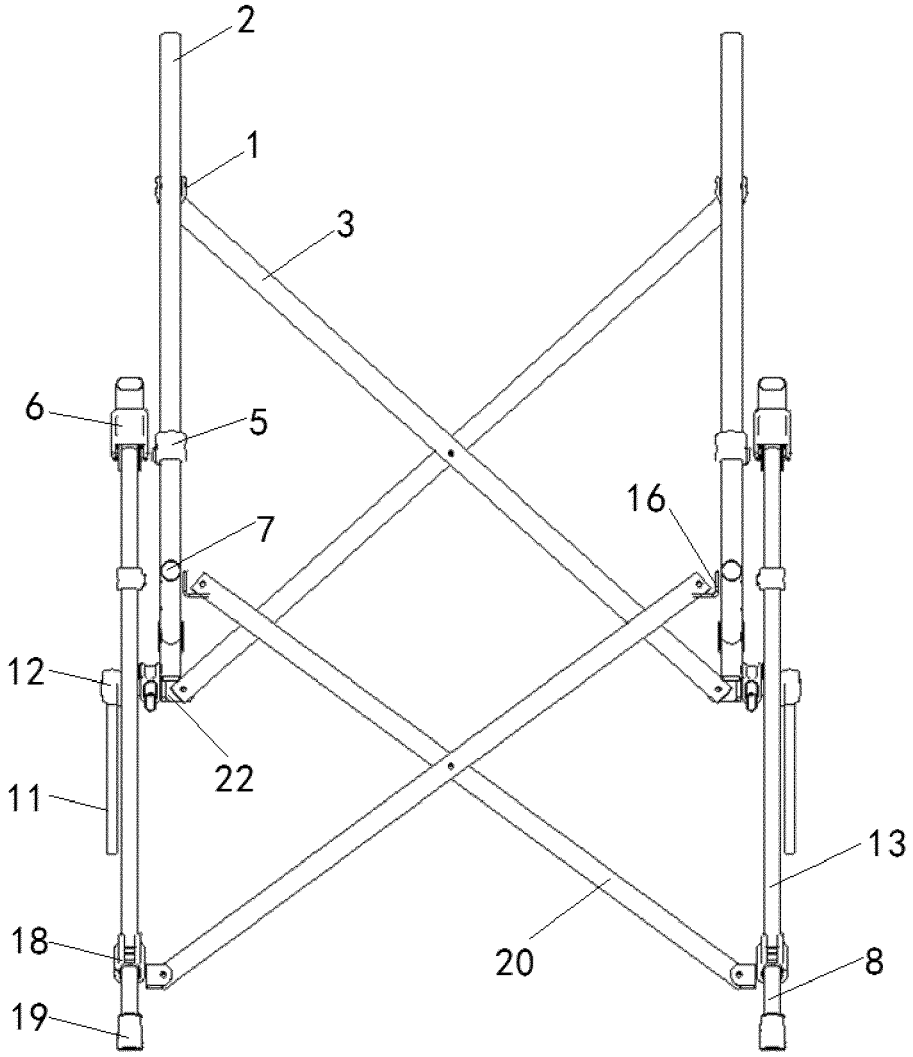
FIG. 3 a front view of the folding chair according to FIG. 1.

A folding chair is provided according to the present disclosure. As shown in FIGS. 1 to 3, the folding chair includes two sets of link assemblies. The two sets of link assemblies are respectively located at two sides of the folding chair in the same arrangement. The two sets of link assemblies are connected to each other to form the folding chair. Reference is made to FIG. 2, which shows a position relationship and a connection relationship of a set of link assembly. Three different embodiments of the rob assembly are described hereinafter.

Each set of link assembly includes: a backrest tube 2, an armrest 4, a seat tube 7, a front foot tube 8, a rear foot tube 9, a connecting tube 10, a flip tube 11, and a supporting rod 13. In a case that the folding chair is unfolded, the armrest 4 is used to support an arm. The seat tube 7 is located at an outer side of a leg and is used to bear a weight. A bottom end of the front foot tube 8 and a bottom end of the rear foot tube 9 are in contact with the ground to support the chair. The flip tube 11 functions as a connecting portion.

Each of the bottom end of the front foot tube 8 and the bottom end of the rear foot tube 9 may be provided with a foot cover 19 to reduce abrasion. A seat cushion is provided between two seat tubes 7, and a backrest is provided between two backrest tubes 2. Each of the seat tube 7 and the armrest 4 may be implemented by a rigid tube, to further improve the user experience.

The armrest 4 is rotatably connected with the backrest tube 2. For example, as shown in FIG. 2, a left end of the armrest 4 is suspended in the air, and a right end of the armrest 4 is rotatably connected with the backrest tube 2 via an armrest connector 5. The armrest connector 5 may be arranged in a conventional manner, as long as the right end of the armrest 4 is rotatable relative to the backrest tube 2.

The connecting tube 10 is arranged at the bottom of the backrest tube 2. The connecting tube 10 and the backrest tube 2 are slidably connected with each other and are rotatable. That is, the backrest tube 2 and the seat tube 7 as a whole are slidably connected with the connecting tube 10. The seat tube 7 may also be slidably connected with the connecting tube 10, so that the backrest tube 2 and the seat tube 7 (the backrest tube 2 is rotatable relative to the seat tube 7) as a whole are slidably connected with the connecting tube 10.

The connecting tube 10 is rotatably connected with the front foot tube 8. For example, as shown in FIG. 2, in the case that the folding chair is unfolded, the connecting tube 10 is located below the backrest tube 2. A left end of the connecting tube 10 is rotatably connected with the front foot tube 8. The connecting tube 10 is slidable leftwards and rightwards relative to the backrest tube 2 or the seat tube 7, and the connecting tube 10 is rotatable relative to the backrest tube 2 or the seat tube 7. As shown in FIG. 2, the front foot tube 8 is rotatably connected with the seat tube 7. In the case that the folding chair is unfolded, a joint between the front foot tube 8 and the seat tube 7 is above a joint between the connecting tube 10 and the front foot tube 8.

A top end of the front foot tube 8 is rotatably connected with a top end of the rear foot tube 9. As shown in FIG. 2, the top end of the front foot tube 8 or the top end of the rear foot tube 9 is fixedly connected with the armrest 4.

One end of the seat tube 7 is rotatably connected with the backrest tube 2, and another end of the seat tube 7 is rotatably connected with the supporting rod 13. For example, as shown in FIG. 2, a right end of the seat tube 7 is rotatably connected with a bottom end of the backrest tube 2. The seat tube 7 is rotatable relative to the backrest tube 2.

A top end of the supporting rod 13 is rotatably connected to a part of the seat tube 7 close to a left end of the seat tube 7.

Two ends of the supporting rod 13 are respectively connected with the seat tube 7 and the front foot tube 8, and the supporting rod 13 is slidably connected with the front foot tube 8. For example, as shown in FIG. 2, the top end of the supporting rod 13 is rotatably connected with the seat tube 7, and a bottom end of the supporting rod 13 may rotate or slide relative to the front foot tube 8.

One end of the flip tube 11 is rotatably connected with the rear foot tube 9, and another end of the flip tube 11 is rotatably connected with the connecting tube 10. For example, as shown in FIG. 2, in the case that the folding chair is unfolded, a top end of the flip tube 11 is rotatably connected with the connecting tube 10, and a bottom end of the flip tube 11 is rotatably connected with the rear foot tube 9.

In the case that the folding chair is unfolded, referring to FIG. 2, an angle between the front foot tube 8 and the rear foot tube 9 reaches the biggest. The connecting tube 10 and the seat tube 7 are not parallel to each other. The connecting tube 10 inclines leftwards relative to the seat tube 7. The flip tube 11 and the rear foot tube 9 are substantially parallel to each other. The supporting rod 13 supports the seat tube 7. The rear cross tube 3 and the supporting rod 13 are respectively located at two sides of the backrest tube 2. The connecting tube 10 is located at an inner side of each of the front foot tube 8 and the rear foot tube 9. The flip tube 11 is located at an outer side of the rear foot tube 9, and is connected with the connecting tube 10. In this case, the flip tube 11 and the connecting tube 10 may be connected with each other via a flip connector 12. When the flip tube 11 flips to a position as shown in FIG. 2, the flip connector 12 may prevent the flip tube 11 from continuing to rotate in a counterclockwise direction. In this case, the connecting tube 10 is in a fixed position, and the front foot tube 8 and the rear foot tube 9 are in fixed positions, the armrest 4, the backrest tube 2 and the seat tube 7 are all fixed under the effect of the front foot tube 8 and the connecting tube 10. All components shown in FIG. 2 are in a stationary state, and the chair is ready for being seated.

Figure 4:
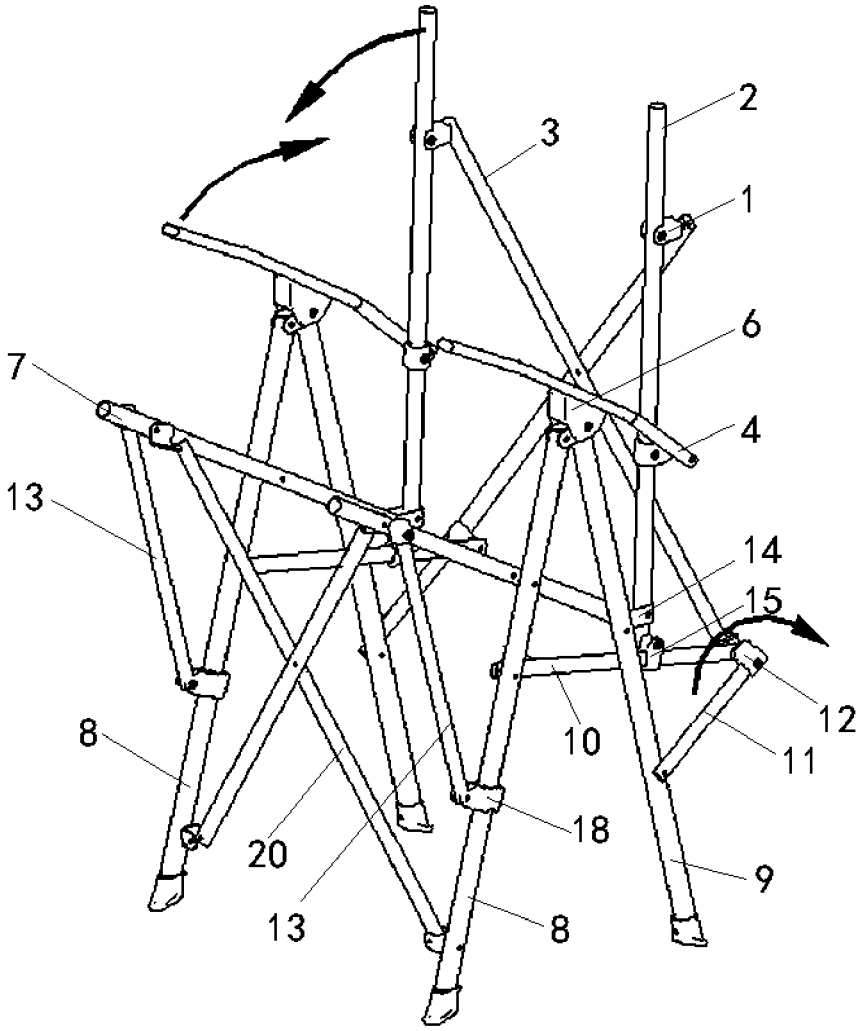
FIG. 4 a process of folding the folding chair according to FIG. 1.

When the folding chair is folded, referring to FIG. 4, the bottom end of the front foot tube 8 and the bottom end of the rear foot tube 9 move towards each other. A top end of the seat tube 7 and a top end of the backrest tube 2 move towards each other. The flip tube 11 and the connecting tube 10 rotate towards a direction close to the ground relative to the rear foot tube 9. The seat tube 7 and the backrest tube 2 slide towards a direction close to the flip tube 11 relative to the connecting tube 10. The supporting rod 13 slides towards a direction close to the armrest 4 relative to the front foot tube 8. When the folding chair is unfolded, the bottom of the front foot tube 8 and the bottom of the rear foot tube 9 move away from each other. The top end of the seat tube 7 and the top end of the backrest tube 2 move away from each other. The flip tube 11 and the connecting tube 10 rotate towards a direction away from the ground relative to the rear foot tube 9. The supporting rod 13 slides towards a direction away from the armrest 4 relative to the front foot tube 8. The supporting rod 13 supports the seat tube 7 at the front foot tube 8.

Figure 5:
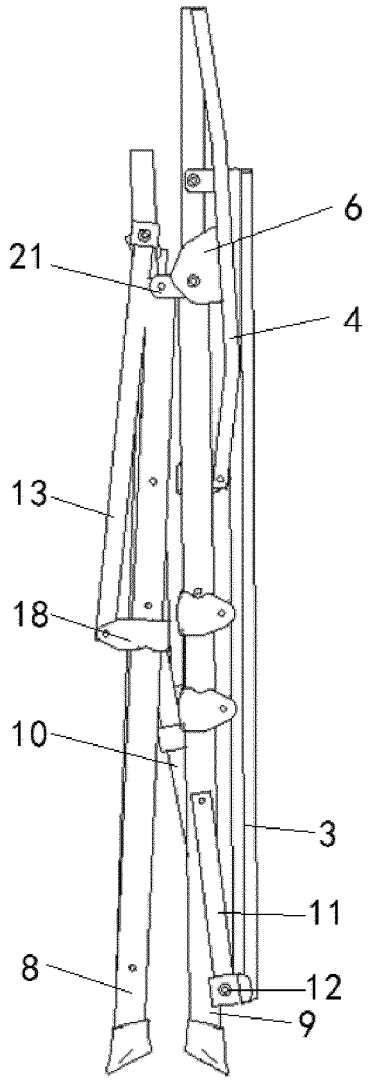
FIG. 5 a side view of the folding chair according to FIG. 1 after being folded.
Figure 6:
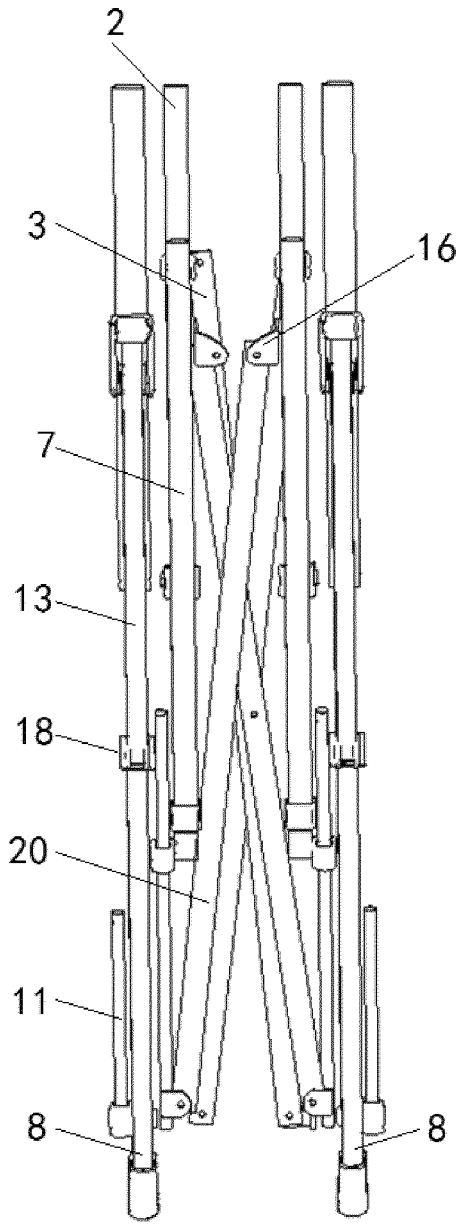
FIG. 6 a front view of the folding chair according to FIG. 5.

The folding chair further includes two rear cross tubes 3 that are crosswise to each other and two supporting tubes 20 that are crosswise to each other. The two rear cross tubes and the two supporting tubes are arranged to connect the two sets of link assemblies. As shown in FIGS. 1, 2 and 4, a top end of the rear cross tube 3 is rotatably connected with the backrest tube 2, and a bottom end of the rear cross tube 3 is rotatably connected with the connecting tube 10. A top end of the supporting tube 20 is rotatably connected with the seat tube 7, and a bottom end of the supporting tube 20 is rotatably connected with the front foot tube 8. When the folding chair is folded, the two rear cross tubes 3 and the two supporting tubes 20 rotate relatively, and the two sets of link assemblies move towards each other, as shown in FIGS. 5 and 6.

The top end of the rear cross tube 3 may be rotatably connected with the backrest tube 2 via a backrest connector 1. The backrest connector 1 may be arranged in a conventional manner.

As shown in FIG. 1, the rear cross tube 3 is hinged to the connecting tube 10 via a rear cross tab 22. The rear cross tab 22 is in a bent shape. One bent edge of the rear cross tab is hinged to the connecting tube 10, and another bent edge of the rear cross tab extends inwards and is hinged to the bottom end of the rear cross tube 3. The rear cross tab 22 is arranged at the flip connector 12. When the folding chair is folded, the rear cross tube 3 and the connecting tube 10 are driven by the flip tube 11 to rotate relative to the rear foot tube 9, and the two sets of link assemblies move towards each other. A direction of an arrow shown in FIG. 4 illustrates a direction of movement of the folding chair when being folded.

The front foot tube 8 is provided with a connector hinged to the bottom end of the supporting tube 20. The front foot tube 8 is sleeved with a front foot slider 18 located above the connector. The front foot slider 18 is slidable relative to the front foot tube 8. The bottom end of the supporting rod 13 is hinged to the front foot slider 18, as shown in FIG. 4. The top end of the supporting rod 13 may be provided with a supporting rod cover 17 to protect a hand from hurting.

Referring to FIGS. 1 and 3, the seat tube 7 is provided with a front cross tab 16. The front cross tab 16 includes a fixing plate and a hinge plate that are integrally formed with each other. The front cross tab 16 may be formed by bending a metal plate. The hinge plate extends towards a direction of the supporting tube 20. The fixing plate is fixedly connected with the seat tube 7. The hinge plate is hinged to the supporting tube 20. That is, the supporting tube 20 is connected with the seat tube 7 via the front cross tab 16.

Referring to FIGS. 1, 2 and 4, the seat tube 7 is rotatably connected with the backrest tube 2 via a U-shaped piece 14. The U-shaped piece 14 includes a fixing ring and two connecting walls. The fixing ring is sleeved on a sidewall of the backrest tube 2. The two connecting walls are connected with the fixing ring. The two connecting walls extend towards a direction away from the backrest tube 2. The fixing ring and the two connecting walls form a structure having an approximately U shape. One end of the seat tube 7 is rotatably connected between the two connecting walls. A slider 15 is fixed to the bottom of the backrest tube 2. The slider 15 is sleeved on the connecting tube 10, so that the connecting tube 10 can slide relative to the slider 15.

An armrest supporting member 6 is arranged on a lower surface of the armrest 4. The armrest 4 is fixedly connected with the armrest supporting member 6. The armrest supporting member 6 is connected with the top end of the rear foot tube 9 via a shaft. The shaft is rotatably connected with a U-shaped weld piece 21. Two wings of the U-shaped weld piece 21 are respectively welded to two opposite sides of the top end of the front foot tube 8. That is, the front foot tube 8 may rotate in synchronism with the armrest 4, the armrest supporting member 6 and the rear foot tube 9.

Figure 7:
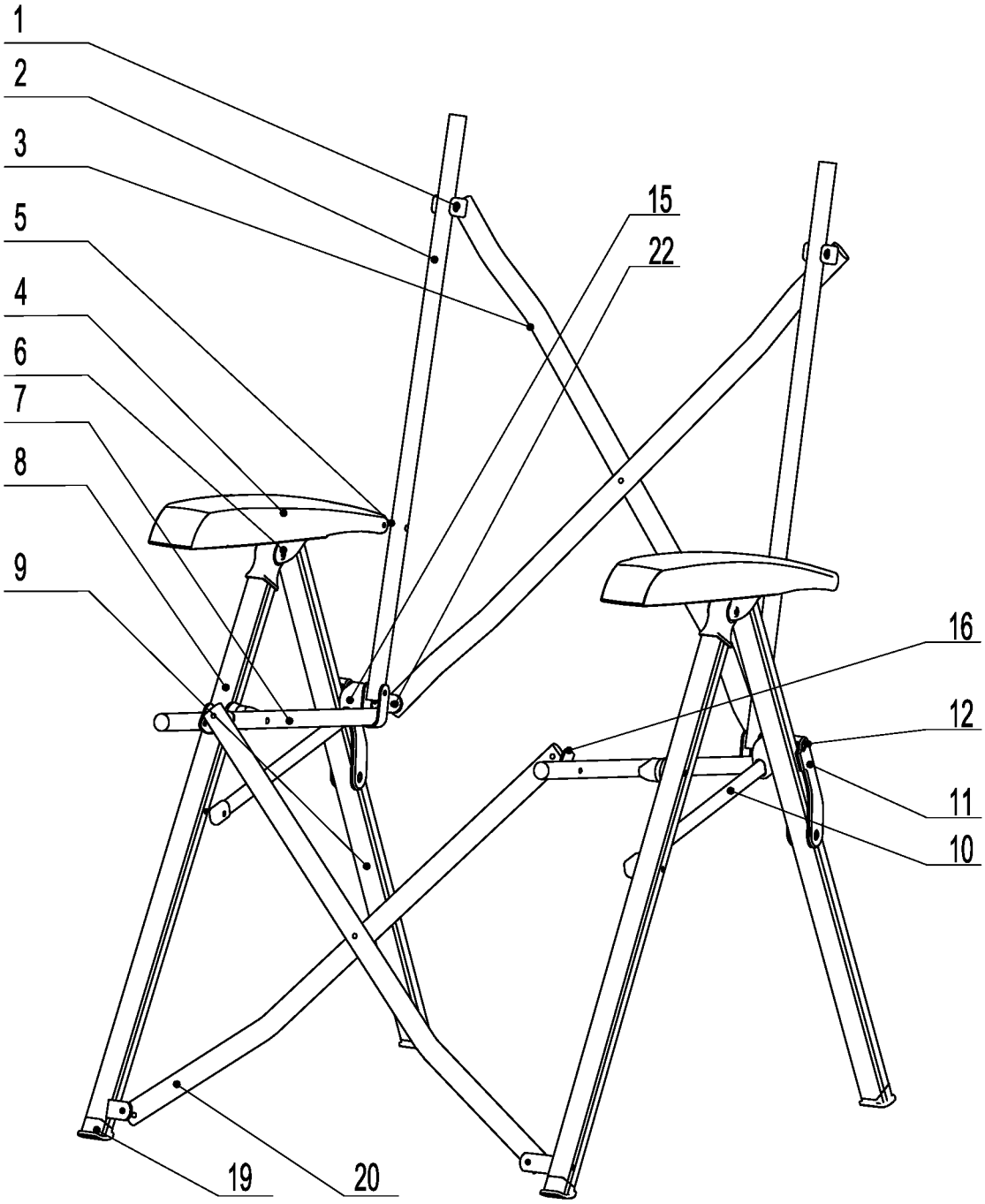
FIG. 7 a modified folding chair based on the folding chair as shown in FIGS. 1 to 6.

FIG. 7 shows the folding chair as described above according to FIGS. 1 to 6. The folding chair according to FIG. 7 differs from the folding chairs as shown in FIGS. 1 to 6 in the connection of the seat tube 7 and the front foot tube 8. It has been found that the stability of the connection between the supporting tube 20 and the front foot tube 8 is stable enough so that the supporting rod 13 can be omitted. Thus, the folding chair according to FIG. 7 is not provided with a supporting rod 13.

Figure 8:
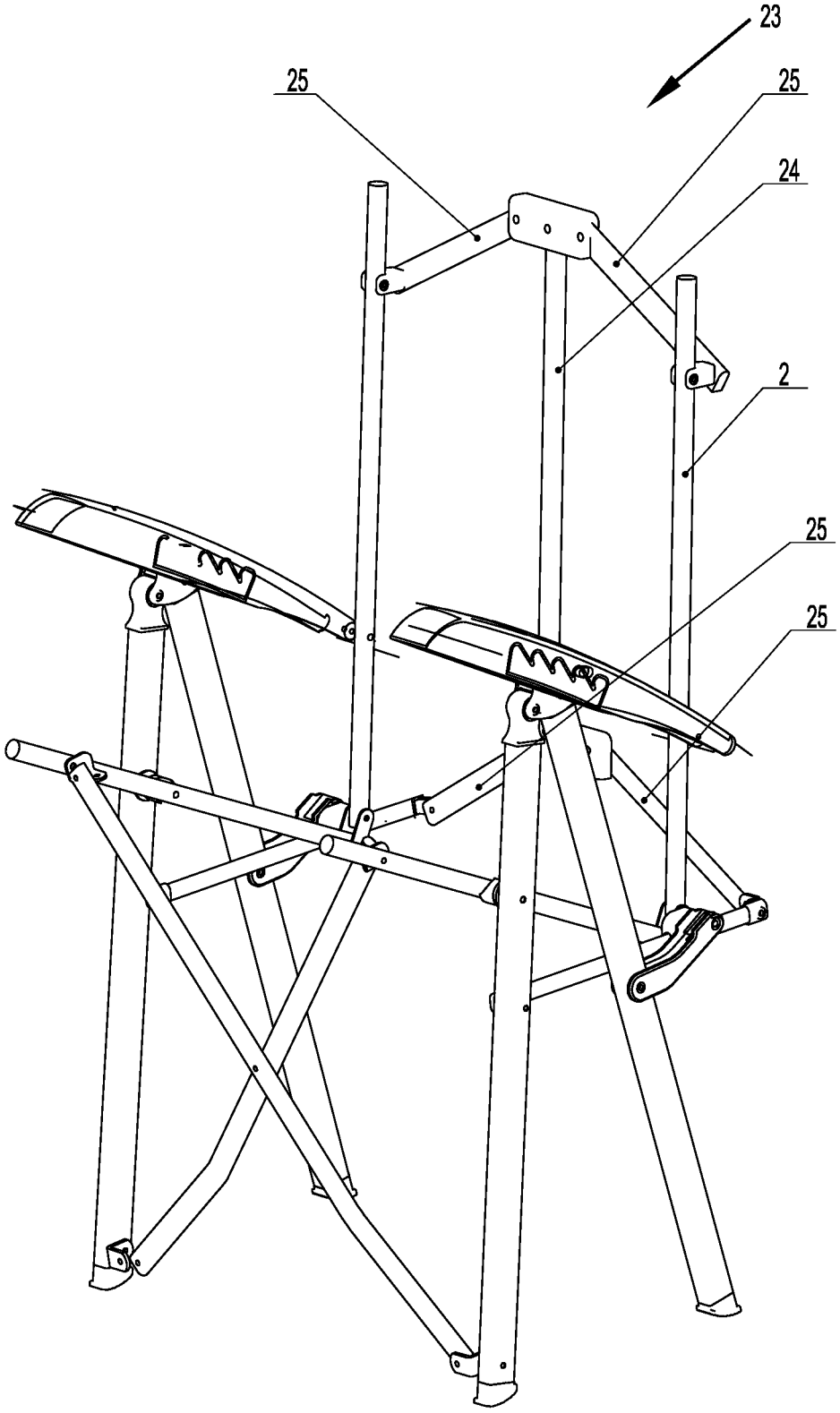
FIG. 8 a modified folding chair based on the folding chair as shown in FIG. 7 partially folded.
Figure 9:
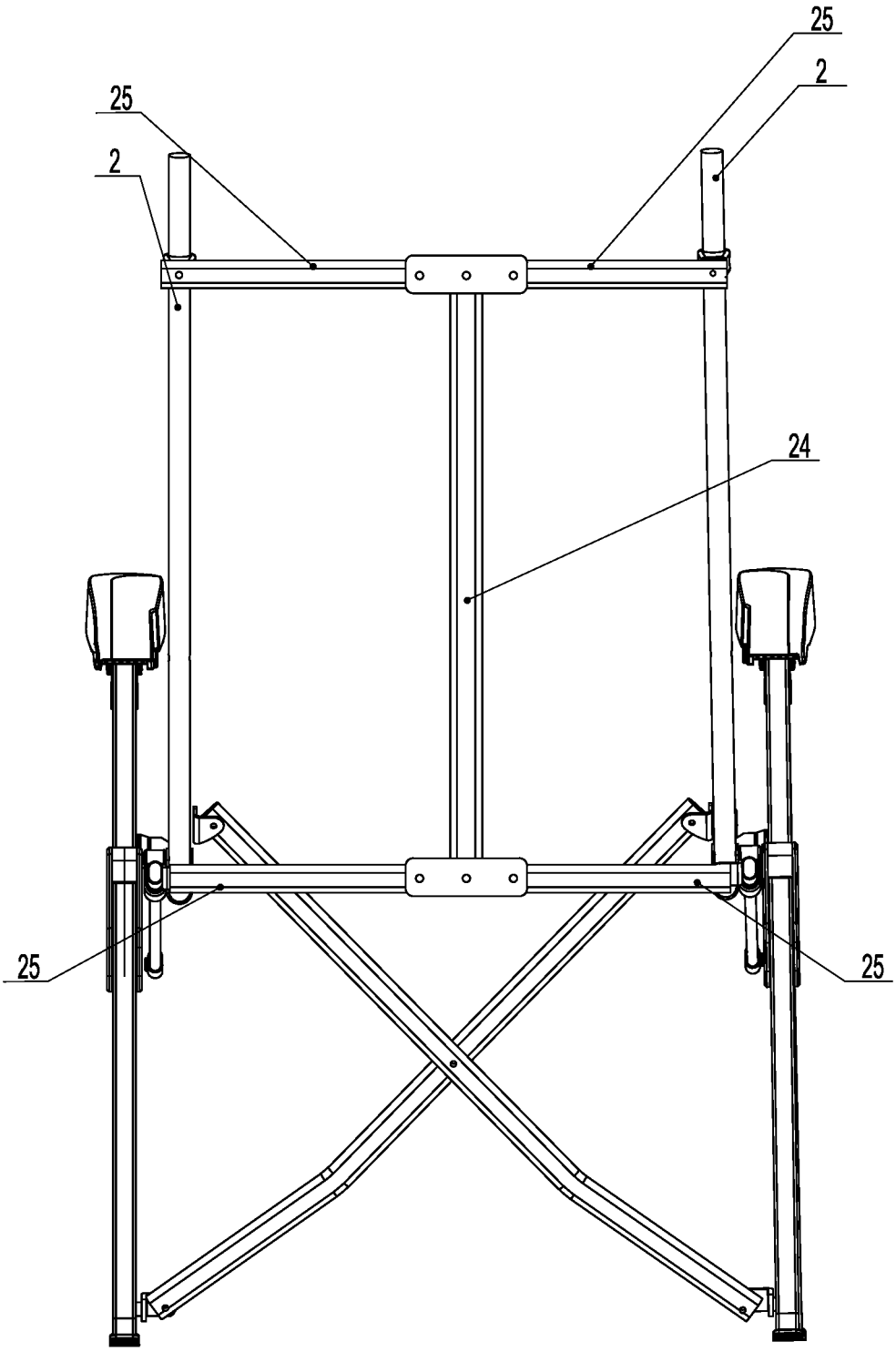
FIG. 9 a back view of the folding chair according to FIG. 8 in unfolded position.

FIGS. 8 and 9 show a further development of the folding chair as shown in FIG. 7. The backrest of the folding chair is provided with a rear tube folding arrangement 23 comprising a middle tube 24 arranged between the backrest tubes 2 and the folding tubes 25. The folding tubes 25 are rotatably connected to the middle tube 24 and to the backrest tubes 2. The rear tube folding arrangement 23 replaces the rear cross tubes 3.

In order to fold the folding chair, the middle tube 24 is moved upwards parallel to the backrest tubes 2. When moving the middle tube 24, the backrest tubes 2 and the folding tubes 25 move along a parallelogram so that the chair folds. Due to the rear tube folding arrangement 23 it is easy to fold the folding chair.

It should be noted that, relationship terminologies such as "first" and "second" in this specification are only used to distinguish one entity or operation from another, rather than to necessitate or imply that the actual relationship or order exists between the entities or operations.

The folding chair according to the embodiments of the present disclosure has been described in detail. The principle and the embodiments of the present disclosure are illustrated by means of specific examples. The above description for the embodiments is only used for helping to understand the present disclosure. It should be noted that, various alternations, and modifications may be made to the technical solutions of the present disclosure by those skilled in the art without departing from the principle of the present disclosure, which also fall into the protection scope of the claims of the present disclosure.

The invention claimed is:

1. A folding chair, comprising two sets of link assemblies that are connected to each other and are respectively located at two sides of the folding chair, wherein the link assembly comprises at least a backrest tube, an armrest, a seat tube, a front foot tube, a rear foot tube, a connecting tube and a connecting portion, wherein the armrest is operatively rotatably connected with the backrest tube, wherein the connecting tube is operatively rotatably connected with the backrest tube, wherein the connecting tube is operatively rotatably connected with the front foot tube, wherein a top end of the front foot tube is operatively rotatably connected with a top end of the rear foot tube, wherein at least one of the top end of the front foot tube and the top end of the rear foot tube is operatively connected with the armrest, wherein the seat tube is operatively rotatably connected with the backrest tube and the front foot tube, wherein at least one of the seat tube and the backrest tube is operatively slidably connected with at least one of the rear foot tube and the connecting tube, wherein the connecting portion is operatively rotatably connected with the connecting tube, and wherein the connecting portion is operatively connected with the rear foot tube; wherein the connecting portion is a flip tube, one end of the flip tube is operatively rotatably connected with the rear foot tube, and another end of the flip tube is operatively rotatably connected with the connecting tube, the flip tube is located at rearward facing side of the rear foot tube.

2. A folding chair according to claim 1, further comprising a supporting rod, wherein two ends of the supporting rod are respectively operatively rotatably connected with the seat tube and the front foot tube, and wherein the supporting rod and the front foot tube are slidable.

3. A folding chair according to claim 1, further comprising two rear cross tubes that are crosswise to each other and two supporting tubes that are crosswise to each other, wherein the two rear cross tubes and the two supporting tubes are arranged to connect the two sets of link assemblies, wherein a top end of the rear cross tube is operatively rotatably connected with the backrest tube, wherein a bottom end of the rear cross tube is operatively rotatably connected with the connecting tube, wherein a top end of the supporting tube is operatively rotatably connected with the seat tube, wherein a bottom end of the supporting tube is operatively rotatably connected with the front foot tube; wherein the two rear cross tubes and the two supporting tubes rotate relatively when the folding chair is folded, and wherein the two sets of link assemblies move towards each other when the folding chair is folded.

4. A folding chair according to claim 3, wherein the front foot tube has a connector hinged to the bottom end of the supporting tube, the front foot tube is sleeved with a front foot slider located above the connector and slidable relative to the front foot tube, and a bottom end of the supporting rod is operatively hingedly connected to the front foot slider.

5. A folding chair according to claim 4, wherein the seat tube has a front cross tab, wherein the front cross tab comprises a fixing plate and a hinge plate that are integrally formed with each other, wherein the hinge plate extends towards a direction of the supporting tube, wherein the fixing plate is fixedly connected with the seat tube and wherein the hinge plate is hinged to the supporting tube.

6. A folding chair according to claim 1 wherein the seat tube is rotatably connected with the backrest tube via a U-shaped piece, wherein the U-shaped piece comprises a fixing ring sleeved on the backrest tube and two connecting walls connected to the fixing ring, wherein the two connecting walls extend towards a direction away from the backrest tube, wherein one end of the seat tube is rotatably connected between the two connecting walls, wherein a slider is fixed to the bottom of the backrest tube, and wherein the slider is sleeved on the connecting tube to cause the connecting tube to slide relative to the slider.

7. A folding chair according to claim 6, further comprising an armrest supporting member arranged on a lower surface of the armrest, wherein the armrest supporting member is operatively connected with the top end of the rear foot tube via a shaft that is rotatably connected with a U-shaped weld piece, wherein two wings of the U-shaped weld piece are respectively welded to two opposite sides of the top end of the front foot tube.

8. A folding chair according to claim 1, further comprising a rear tube folding arrangement with a middle tube to which folding tubes are operatively rotatably connected, wherein the folding tubes are rotatably connected to the backrest tube.

9. A folding chair, comprising two sets of link assemblies that are connected to each other and are respectively located at two sides of the folding chair, wherein the link assembly comprises at least a backrest tube, an armrest, a seat tube, a front foot tube, a rear foot tube, a connecting tube, a flip tube, a supporting rod, wherein the armrest is operatively rotatably connected with the backrest tube, wherein the connecting tube is operatively slidably and operatively rotatably connected with the backrest tube, wherein the connecting tube is operatively rotatably connected with the front foot tube, wherein a top end of the front foot tube is operatively rotatably connected with a top end of the rear foot tube, wherein at least one of the top end of the front foot tube and the top end of the rear foot tube is operatively connected with the armrest, wherein the seat tube is operatively rotatably connected with the backrest tube and the front foot tube, wherein at least one of the seat tube and the backrest tube is operatively slidably connected with one of the rear foot tube and the connecting tube, wherein the flip tube is operatively rotatably connected with the connecting tube, and wherein the flip tube is operatively connected with the rear foot tube, the flip tube being located at rearward facing side of the rear foot tube.

10. A folding chair according to claim 9 wherein each of the link assemblies has a support rod, the supporting rod having two ends being respectively rotatably connected with the seat tube and the front foot tube, and wherein the supporting rod and the front foot tube are operatively slidably connected.

11. A folding chair according to claim 9 wherein each of the link assemblies has a slider operatively slidingly disposed on the connecting tube, at least one of the back rest tube and the seat tube being operatively pivotally connected to the slider.

12. A folding chair according to claim 11 wherein the slider is fixed to the bottom of the backrest tube.

13. A folding chair according to claim 9 further comprising two rear cross tubes crosswise to each other, the two rear cross tubes being arranged to connect the two sets of link assemblies.

14. A folding chair according to claim 13 wherein a bottom of each rear cross tube is operatively pivotally connected to the connecting tube.

15. A folding chair according to claim 9 further comprising the two supporting tubes being crosswise to each other, the two supporting tubes being arranged to connect the two sets of link assemblies.

16. A folding chair according to claim 9 wherein the flip tube is connected to the connecting tube with a flip connector, the flip connector being adapted and configured to prevent pivoting of the flip tube when the folding chair is unfolded.

17. A folding chair according to claim 10 wherein an angle between the front foot tube and the rear foot tube is largest when the folding chair is unfolded and smallest when the folding chair is folded.

18. A folding chair according to claim 10, wherein the connecting tube and the seat tube are at an acute angle to each other when the folding chair is unfolded and wherein the flip tube and the rear foot tube are substantially parallel to each other when the folding chair is unfolded.

19. A folding chair according to claim 9 further comprising a middle tube assembly disposed between the backrest tubes and being arranged to connect the two sets of link assemblies, the middle tube assembly comprising a middle tube and folding tubes, the folding tube being operatively pivotally connected between the middle tube and the backrest tubes.

* * * * *